US005551800A

United States Patent [19]

Hobelsberger

[11] Patent Number: 5,551,800

[45] **Date of Patent: * Sep. 3, 1996**

[54] DEVICE WITH ADJUSTABLE BUOYANCY WITH PRESSURE COMPENSATION

[76] Inventor: Maximilian Hobelsberger, Dorfstr. 16, CH-5303 Würenlingen, Switzerland

[ * ] Notice: The portion of the term of this patent subsequent to Mar. 6, 2014, has been disclaimed.

[21] Appl. No.: 48,298

[22] Filed: Apr. 19, 1993

[51] Int. Cl.[6] ..... B63C 11/08

[52] U.S. Cl. ..... 405/186; 405/185

[58] Field of Search ..... 405/185, 186, 405/193

[56] References Cited

U.S. PATENT DOCUMENTS

| | | | |
|---|---|---|---|
| 2,742,654 | 4/1956 | Hurt | 405/186 X |
| 3,695,048 | 10/1972 | Dimick | 405/186 |
| 3,820,348 | 6/1974 | Fast | 405/186 |
| 3,877,098 | 4/1975 | Braly | 405/186 |
| 3,964,266 | 6/1976 | Bartlett | 405/186 |
| 4,114,389 | 9/1978 | Bohmrich et al. | 405/186 |
| 4,187,796 | 2/1980 | Ess | 405/193 X |
| 4,324,507 | 4/1982 | Harrah | 405/186 |
| 4,437,790 | 3/1984 | Trop | 405/186 |
| 4,601,609 | 7/1986 | Hyde | 405/186 |

*Primary Examiner*—John A. Ricci

[57] ABSTRACT

The device for buoyancy is intended to be used by scuba divers. It allows the adjustment of its buoyancy and keeps this buoyancy constant even at changing water pressure. Its weight is low. The device works with a mechanism for pressure control. The controller keeps the pressure difference between the inside and the outside of the tank constant. The walls of the tank are expandable to allow the adjustment of the displaced volume.

4 Claims, 2 Drawing Sheets

DEVICE WITH ADJUSTABLE BUOYANCY WITH PRESSURE COMPENSATION

BACKGROUND OF THE INVENTION

1. Field of the Invention

This invention relates to buoyancy compensators for scuba divers which automatically maintain a predetermined buoyancy.

2. Prior Art

The invention concerns a low-weight device for buoyancy which is intended to be used by divers. The force of buoyancy can be adjusted. Scuba divers usually need a device for buoyancy to compensate their weight while diving to prevent them from sinking or floating to the surface. The buoyancy must be adjustable because the diver's weight changes while diving. Usually a kind of bag is used which is attached to the body and which is filled with different quantities of air. The buoyancy of these diving devices depends on the air volume inside the bag. This volume is not constant, it depends on the water pressure. As the diver sinks the pressure rises with the depth, the volume decreases, the buoyancy decreases too and the diver sinks even faster. This is usually an undesired, sometimes a dangerous effect.

Several improvements have been made to provide a buoyancy compensator with constant, adjustable buoyancy:

East's U.S. Pat. No. 3,820,348 discloses an automatic buoyancy device with a flexible bladder between two rigid plates. The plates, together with a cable mechanism, sense changes of the bladder volume and compensate these changes by allowing the bladder to inflate or deflate. A disadvantage of this device is its rather complicated and bulky construction.

Bohmrich's device (U.S. Pat. No. 4,114,389) consists of a rigid constant volume chamber filled with air. By admitting water into the chamber the buoyancy can be changed. Again this device is bulky and in addition difficult to handle, as several valves must be activated to let the water in or out.

SUMMARY OF THE INVENTION

It is an object of this invention to provide an automatic buoyancy compensator maintaining a set buoyancy, which is simple to operate, lightweight, not bulky, comfortable to wear and cheap.

The device according to the invention is a device with an adjustable buoyancy, which is almost independent of the water pressure. In addition, the weight of the device is low because the walls of the device are made of a light-weight material.

The buoyancy compensator consists of a container at which the displaced volume depends on the pressure difference between inside and the ambient. The pressure difference is measured, either mechanically or electronically. The measured value is conveyed to a controller which in turn steers the valves through which air can be released or filled into the tank. The air is received from the diver's compressed air tank. The controlled pressure difference can be adjusted by the diver while diving and is kept constant at the selected value by the said pressure controller. Therefore the inner gas volume, and with it the buoyancy, is kept constant at the selected value too. The container is constructed with expandable walls to allow the change of the volume in response to the adjustments of the pressure difference. The adjustment of the pressure difference can be done by the diver at normal operation of the compensator, i.e. without having to take it appart.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1A:
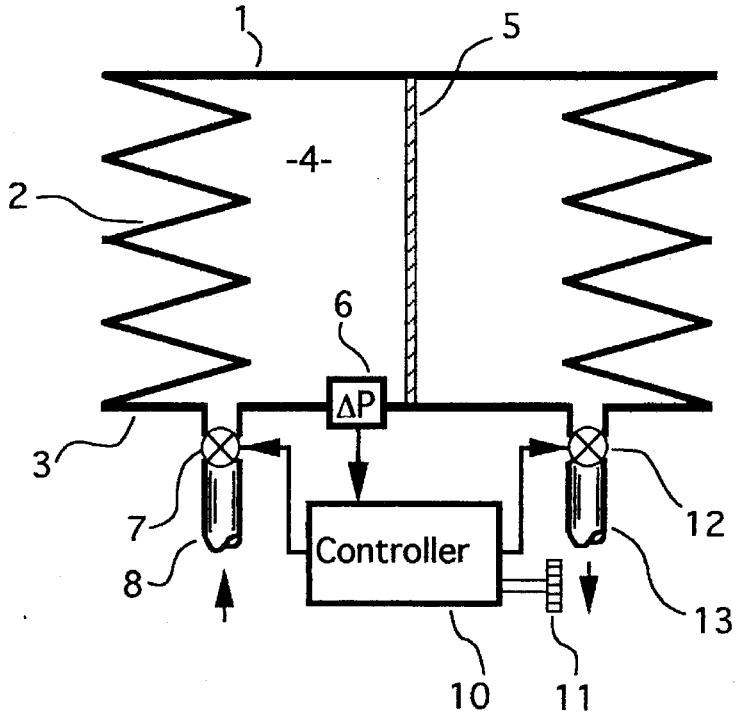
FIG. 1A illustrates a first preferred embodiment of the invention.
Figure 1B:
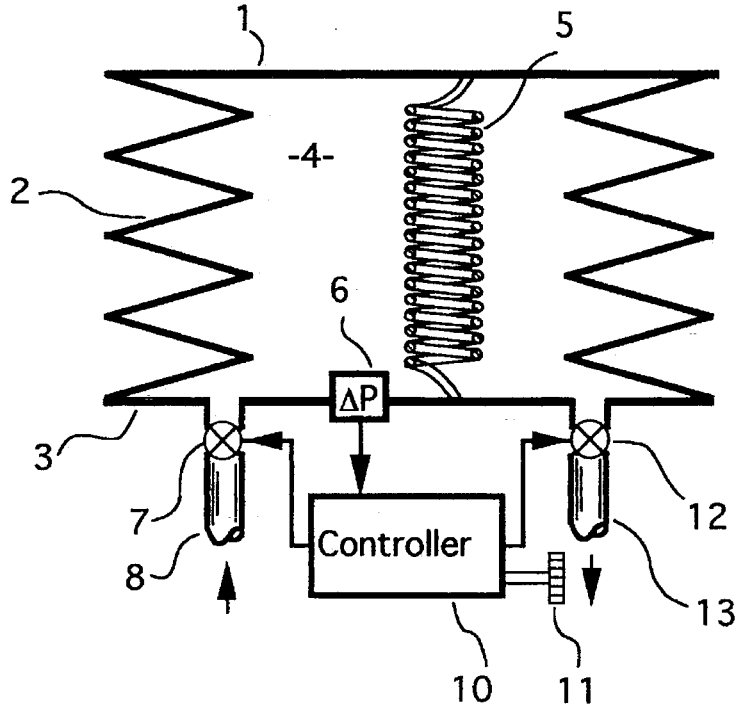
FIG. 1B illustrates an alternate of the first embodiment.

The following is a description of a first embodiment of the invention and refers to FIGS. 1A and 1B.

The buoyancy compensator consists of an expandable and airtight bellows 2 with a cover 1 and a bottom 3. The bottom is connected to the cover by an expandable rubber string or coil spring of metal 5. The bottom is equipped with two valves 7, 12. Through the valve 7 pressurised air from the diver's pressurised air tank can be fed into the container, through the valve 12 air can escape from the container. Pressure measuring means 6 is provided to measure the pressure difference between inside, 4, and outside. This means may be mechanical or electronic and is well known to the skilled. The sensed pressure difference influences the controller 10. This controller activates either the inlet valve 7 to increase the pressure inside the container, or the outlet valve 12 to decrease the pressure. The control mechanism is designed so that the pressure difference is held constant to a adjustable value. This value may be adjusted by the diver while diving in order to change the buoyancy by the knob 11.

Designs for adjustable pressure control mechanisms are well known to the skilled.

Depending on the selected value of pressure difference the rubber string 5 will be more or less stretched. Therefore the inner air volume, and with it the buoyancy, is kept constant at the selected value too.

Figure 2A:
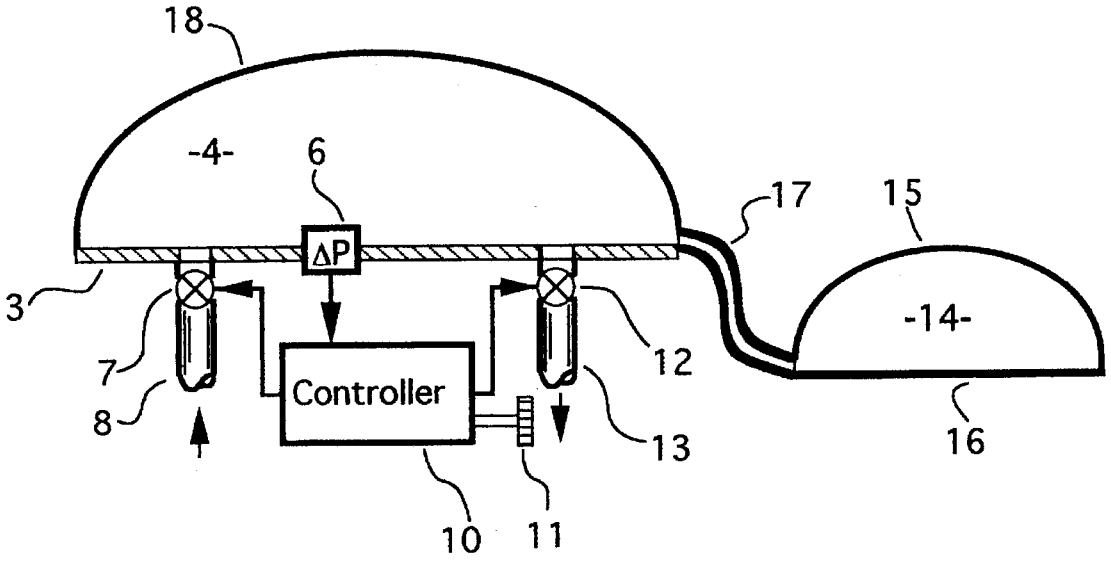
FIG. 2A shows a second preferred embodiment.

FIG. 2*a* shows a container similar to that of FIG. 1A. The walls 18 are made of an expandable, elastic material like rubber. Increasing pressure difference will increase the length of the walls and therefore also increase the displaced volume. The inner elastic string is omitted in this construction. Via a flexible, but not expandable hose 17 a second chamber 14 is connected to the first chamber 4. This chamber consists again of a bottom 16 and expandable walls 15.

Figure 2B:
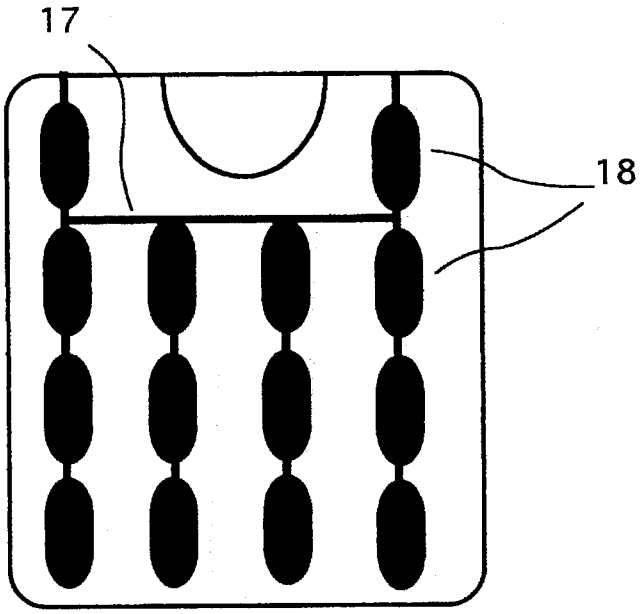
FIG. 2B shows the buoyancy compensator in the shape of a diving vest.

This multi-chamber design allows the design of a diving vest (FIG. 2*b*) using this principle of buoyancy control. The vest is shaped as a jacket to be worn by the scuba diver. The jacket consists of many chambers 18 which are connected to each other via hoses so that gas can pass from one chamber to the next. The walls of the chambers consist of an expandable, elastic material like rubber. The chambers can be inflated or deflated according to the described mechanism. Rising pressure difference between inside and outside will increase the volume of displacement of the jacket.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. Adjustable buoyancy compensator for scuba divers, comprising:

a hollow, airtight container, the volume of which depends on the pressure difference between inside and outside of the container, valves through which air can be released from the inside to the outside and can be fed into the container, means for measuring the air pressure difference between inside and outside of the container, a pressure controller, which is stimulated by said means for measuring the pressure difference, and which keeps the pressure difference constant by steering the input or output valves to release air from or to refill air into the container, whereby the value of the pressure difference can be adjusted by the diver for adjustment of the buoyancy while diving and at normal operation of the compensator.

2. Compensator of claim 1, whereby the walls of the container are shaped like the bellows of an accordion and are foldable and expandable, and whereby the top and the bottom of the container are connected to each other by strings of elastic material or by metal springs.

3. Compensator of claim 1, whereby the walls of the container consist of an expandable, elastic material so that a change of the pressure difference between inside and outside of the container changes the length of these walls.

4. Compensator of claim 3, whereby the compensator consists of a multitude of chambers which are connected to each other by flexible hoses, and whereby the compensator is shaped like a jacket.

* * * * *